US010051884B2

(12) United States Patent
Karles et al.

(10) Patent No.: US 10,051,884 B2
(45) Date of Patent: Aug. 21, 2018

(54) CONTROLLED RELEASE MENTHOLATED TOBACCO BEADS

(75) Inventors: Georgios D. Karles, Richmond, VA (US); Shuzhong Zhuang, Richmond, VA (US); Yi Zeng, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/748,259

(22) Filed: Mar. 26, 2010

(65) Prior Publication Data

US 2011/0232657 A1 Sep. 29, 2011

(51) Int. Cl.

| | |
|---|---|
| ***A24B 15/30*** | (2006.01) |
| ***A24B 15/28*** | (2006.01) |
| ***A24B 15/18*** | (2006.01) |

(52) U.S. Cl.

CPC ..... *A24B 15/283* (2013.01); *A24B 15/186* (2013.01); *A24B 15/30* (2013.01)

(58) Field of Classification Search

None

See application file for complete search history.

(56) References Cited

U.S. PATENT DOCUMENTS

| | | | | |
|---|---|---|---|---|
| 639,365 A | | 12/1899 | Dudley | |
| 1,376,586 A | | 5/1921 | Schwartz | |
| 3,203,432 A | | 8/1965 | Green et al. | |
| 3,353,543 A | | 11/1967 | Sproull et al. | |
| 3,550,598 A | * | 12/1970 | McGlumphy ..... | A24B 15/283 131/274 |

(Continued)

FOREIGN PATENT DOCUMENTS

| | | |
|---|---|---|
| EP | 0212234 A2 | 7/1986 |
| EP | 0352107 A2 | 1/1990 |

(Continued)

OTHER PUBLICATIONS

International Search Report and Written Opinion dated Jul. 29, 2011 for PCT/EP2011/001501.

(Continued)

*Primary Examiner* — Michael J Felton

*Assistant Examiner* — Phu Nguyen

(74) *Attorney, Agent, or Firm* — Buchanan Ingersoll & Rooney PC

(57) ABSTRACT

Encapsulated tobacco beads and processes of making the encapsulated tobacco beads are disclosed. According to an embodiment, a process of making encapsulated tobacco beads comprises mixing tobacco particles and menthol in an aqueous solution to form a wet mass; extruding the wet mass to form extrudates; spheronizing the extrudates to form tobacco beads; drying the tobacco beads; contacting the beads with a solution comprising a cation; and introducing the contacted tobacco beads into a solution of coating material in a concentration effective to induce ionic gelation of the coating material around the beads, to form encapsulated tobacco beads having gel coatings. According to another embodiment, an encapsulated tobacco bead comprises a core comprising tobacco particles and encapsulated menthol, an inner coating layer comprising hydroxypropyl methylcellulose or pectin, and an outer coating layer comprising an ionically-crosslinked gel.

11 Claims, 3 Drawing Sheets

(56) References Cited

U.S. PATENT DOCUMENTS

| | | | |
|---|---|---|---|
| 3,881,024 | A | 4/1975 | Pahoundis, Sr. et al. |
| 4,109,663 | A | 8/1978 | Maeda et al. |
| 4,240,016 | A | 12/1980 | Inaba et al. |
| 4,341,228 | A | 7/1982 | Keritsis et al. |
| 4,347,855 | A | 9/1982 | Lanzillotti et al. |
| 4,355,995 | A | 10/1982 | Berger |
| 4,357,950 | A | 11/1982 | Berger |
| 4,464,434 | A | 8/1984 | Davis |
| 4,510,950 | A | 4/1985 | Keritsis |
| 4,660,577 | A | 4/1987 | Sensabaugh et al. |
| 4,674,519 | A | 6/1987 | Keritsis et al. |
| 4,702,264 | A | 10/1987 | Graves, Jr. |
| 4,821,749 | A | 4/1989 | Toft et al. |
| 4,874,000 | A | 10/1989 | Tamol et al. |
| 4,880,018 | A | 11/1989 | Graves, Jr. et al. |
| 4,893,639 | A | 1/1990 | White |
| 4,917,161 | A | 4/1990 | Townend |
| 4,924,887 | A | 5/1990 | Raker et al. |
| 4,966,171 | A | 10/1990 | Serrano et al. |
| 4,981,522 | A | 1/1991 | Nichols et al. |
| 4,989,620 | A | 2/1991 | Keritsis et al. |
| 5,007,440 | A | 4/1991 | Robinson et al. |
| 5,099,864 | A | 3/1992 | Young et al. |
| 5,105,836 | A | 4/1992 | Gentry et al. |
| 5,148,821 | A | 9/1992 | Best et al. |
| 5,154,927 | A | 10/1992 | Song et al. |
| 5,167,244 | A | 12/1992 | Kjerstad |
| 5,186,185 | A | 2/1993 | Mashiko et al. |
| 5,240,016 | A | 8/1993 | Nichols et al. |
| 5,263,999 | A | 11/1993 | Baldwin et al. |
| 5,339,838 | A | 8/1994 | Young et al. |
| 5,387,416 | A | 2/1995 | White et al. |
| 5,501,237 | A | 3/1996 | Young et al. |
| 5,598,868 | A | 2/1997 | Jakob et al. |
| 5,724,998 | A | 3/1998 | Gellatly et al. |
| 5,725,886 | A | 3/1998 | Erkoboni et al. |
| 5,763,083 | A | 6/1998 | Berrigan |
| 5,829,453 | A | 11/1998 | White et al. |
| 5,845,648 | A | 12/1998 | Martin |
| 5,997,691 | A | 12/1999 | Gautam et al. |
| 6,026,820 | A | 2/2000 | Baggett, Jr. et al. |
| 6,325,859 | B1 | 12/2001 | De Roos et al. |
| 6,840,248 | B2 | 1/2005 | Zielke |
| 6,880,018 | B1 | 4/2005 | Kajiki et al. |
| 6,895,974 | B2 | 5/2005 | Peele |
| 7,032,601 | B2 | 4/2006 | Atchley et al. |
| 7,578,298 | B2 | 8/2009 | Karles et al. |
| 2002/0166563 | A1 | 11/2002 | Jupe et al. |
| 2002/0170567 | A1 | 11/2002 | Rizzotto et al. |
| 2004/0081691 | A1 | 4/2004 | Debregeas et al. |
| 2005/0061339 | A1 | 3/2005 | Hansson et al. |
| 2005/0081264 | A1 | 4/2005 | Brugliera et al. |
| 2005/0098187 | A1 | 5/2005 | Grierson et al. |
| 2005/0178398 | A1 | 8/2005 | Breslin et al. |
| 2005/0241656 | A1 | 11/2005 | Kennison |
| 2005/0244521 | A1 | 11/2005 | Strickland et al. |
| 2005/0279374 | A1 | 12/2005 | McGrath et al. |
| 2006/0144412 | A1 | 7/2006 | Mishra et al. |
| 2006/0191548 | A1 | 8/2006 | Strickland et al. |
| 2006/0263478 | A1* | 11/2006 | Boghani et al. ..... 426/5 |
| 2006/0272662 | A1 | 12/2006 | Jupe et al. |
| 2006/0292280 | A1 | 12/2006 | Soper et al. |
| 2007/0000505 | A1* | 1/2007 | Zhuang et al. ..... 131/342 |
| 2007/0062549 | A1 | 3/2007 | Holton, Jr. et al. |
| 2007/0082030 | A1* | 4/2007 | Aimutis ..... A23L 1/0076 424/439 |
| 2007/0084476 | A1 | 4/2007 | Szu-Sung et al. |
| 2007/0186941 | A1 | 8/2007 | Holton, Jr. et al. |
| 2007/0190157 | A1 | 8/2007 | Sanghvi et al. |
| 2008/0029110 | A1 | 2/2008 | Dube et al. |
| 2008/0138489 | A1 | 6/2008 | Nagao et al. |
| 2008/0173317 | A1 | 7/2008 | Robinson et al. |
| 2008/0202533 | A1 | 8/2008 | Mishra et al. |
| 2008/0302376 | A1* | 12/2008 | Karles ..... A24B 15/282 131/275 |
| 2008/0302682 | A1 | 12/2008 | Engstrom et al. |
| 2008/0308115 | A1 | 12/2008 | Zimmerman et al. |
| 2009/0014018 | A1* | 1/2009 | Sengupta et al. ..... 131/276 |
| 2010/0294290 | A1 | 11/2010 | Zhang |

FOREIGN PATENT DOCUMENTS

| | | | |
|---|---|---|---|
| WO | WO2005/046363 | A | 5/2005 |
| WO | WO2006/090290 | A | 8/2006 |
| WO | WO2007/037962 | A | 4/2007 |
| WO | WO 2011/042211 | A1 | 4/2011 |

OTHER PUBLICATIONS

Chris Vervaet et al., Extrusion-Spheronisation a Literature Review, International Journal of Pharmaceutics, 116 (1995), pp. 131-146.

John C. Leffingwell et al., Tobacco Flavoring for Smoking Products, R. J. Reynolds Tobacco Company, 1972, cover page and table of contents.

F. El Saleh et al., Influence of Cellulose Type on the Properties of Extruded Pellets, S.T.P. Pharma Sciences 10, (5), 2000, pp. 379-385.

Otilia May Yue Koo et al., The Influence of Microcrystalline Cellulose Grade on Shape and Shape Distributions of Pellets Produced by Extrusion-Spheronization, Chem. Pharm. Bull. 49 (11) 2001, pp. 1383-1387.

Petra M. Fecher et al., Properties of Microcrystalline Cellulose and Powder Cellulose After Extrusion/Spheronization as Studied by Fourier Transform Raman Spectroscopy and Environmental Scanning Electron Microscopy, AAPS PharmSci. 2003; 5 (4), Article 31, pp. 1-13.

International Preliminary Report on Patentability dated Aug. 28, 2007 for PCT/IB2006/001114.

International Search Report and Written Opinion dated Jul. 25, 2006 for PCT/IB2006/001114.

International Search Report and Written Opinion dated Feb. 25, 2009 for PCT/IB2008/002566.

International Preliminary Report on Patentability dated Oct. 2, 2012 for PCT/EP2011/001501.

Official Action dated May 7, 2015 for Japanese Patent Appln. No. 2013-500397.

* cited by examiner

CONTROLLED RELEASE MENTHOLATED TOBACCO BEADS

BACKGROUND

Encapsulated tobacco beads having improved storage stability with controlled release of flavorants are disclosed.

SUMMARY

According to an embodiment, a process of making encapsulated tobacco beads comprises mixing tobacco particles and menthol in an aqueous solution to form a wet mass; extruding the wet mass to form extrudates; spheronizing the extrudates to form tobacco beads; drying the tobacco beads; contacting the beads with a solution comprising a cation; and introducing the contacted tobacco beads into a solution of coating material in a concentration effective to induce ionic gelation of the coating material around the beads, to form encapsulated tobacco beads having gel coatings.

In a further embodiment, the contacting with the solution comprising the cation occurs in a fluidized bed simultaneously with the drying the tobacco beads.

According to another embodiment, an encapsulated tobacco bead comprises a core comprising tobacco particles and encapsulated menthol, an inner coating layer comprising hydroxypropyl methylcellulose or pectin, and an outer coating layer comprising an ionically-crosslinked gel.

BRIEF DESCRIPTION OF THE DRAWINGS

The various embodiments will now be described in greater detail with reference to the preferred embodiments illustrated in the accompanying drawings.

DETAILED DESCRIPTION

Generally

Figure 1A:
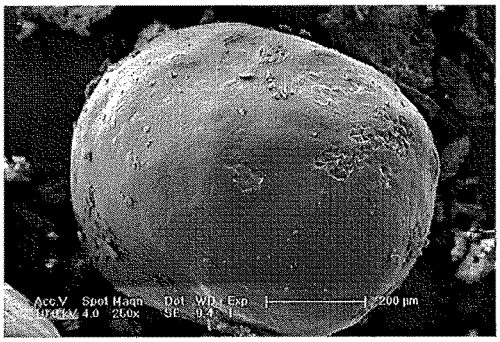
FIGS. 1A and 1B are environmental scanning electron microscopy (ESEM) images of pectin coated mentholated tobacco beads.

As used herein, the term "about" when used in conjunction with a stated numerical value or range denotes somewhat more or somewhat less than the stated value or range, to within a range of ±10% of that stated.

As used herein, the terms "tobacco material" or "tobacco" are intended to include both tobacco (e.g., cut filler, tobacco powder, etc.) and tobacco substitute materials (e.g., vegetable or plant products like shredded lettuce). Thus, both tobacco and tobacco substitute materials are provided herein.

The tobacco material, as mentioned above, can be a tobacco material or a tobacco substitute material. Exemplary tobacco materials can be made of cut or ground tobacco and can include flavorant additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, cultured tobacco, blends thereof and the like.

The tobacco material can be provided in any suitable form, including, but not limited to, tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Tobacco substitutes or genetically modified tobacco may also be used.

Additionally, as mentioned above, the tobacco material can comprise a tobacco substitute material. Exemplary tobacco substitute materials can be made of vegetable or plant fibers, or the like, and can include flavorant additives and/or humectants. Examples of suitable types of tobacco substitute materials that may be used include, but are not limited to, lettuce, cotton, flax, cellulosic fibers, blends thereof and the like.

Smokeless tobacco products refer to orally enjoyable products including, but not limited to, pouched tobacco (also known as snus). One drawback of commercial snus packets is that the tobacco material, as well as additives to the tobacco, can cause staining of the pouch material surrounding the tobacco material.

According to one embodiment, tobacco beads with a core-shell structure are provided. These tobacco beads can provide (1) extended shelf life and product stability, (2) controlled flavorant delivery, (3) potentially reduced exposure to tobacco specific compounds, and/or (4) enhanced sensorial attributes.

Such tobacco beads can provide the attributes mentioned above because, when the pouch is placed in the oral cavity, the outer gel coating layer can provide a controlled-release of flavorant and may provide reduction of tobacco specific compounds by functioning as a barrier either to the compounds themselves or to the compounds bound to a sequestering agent.

Tobacco beads can also be used in smoking articles, as described in commonly-assigned U.S. Patent Application Publication No. 2007/0000505, incorporated herein by reference.

Core

The core of the encapsulated tobacco bead is a spheronized bead comprising tobacco particles and menthol. The tobacco particles are preferably finely ground tobacco. The menthol may be conventional menthol or encapsulated menthol. For example, commercially available encapsulated menthol-gum powder CR200, containing 80 wt % of menthol and 20 wt % of gum arabic (TasteTech, United Kingdom), is a preferred form of menthol.

Optionally, other flavorants are included. The flavorants can be soluble or insoluble in water or organic solvents, such as ethanol or propylene glycol. Flavorants can also be encapsulated for controlled delivery. Suitable flavorants and aromas include, but are not limited to, any natural or synthetic flavorant or aroma, such as tobacco, smoke, mint, such as peppermint and spearmint, chocolate, licorice, citrus and other fruit flavorants, gamma octalactone, vanillin, ethyl vanillin, breath freshener flavorants, spice flavorants such as cinnamon, methyl salicylate, linalool, bergamot oil, geranium oil, lemon oil, and ginger oil. Other suitable flavorants and aromas may include flavorant compounds selected from the group consisting of an acid, an alcohol, an ester, an aldehyde, a ketone, a pyrazine, combinations or blends thereof and the like. Suitable flavorant compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Exemplary additional natural and artificial flavorants include peppermint, spearmint, wintergreen, cinnamon, chocolate, vanillin, licorice, clove, anise, sandalwood, geranium, rose oil, vanilla, lemon oil, cassia, spearmint, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, peppermint oil, orange oil, coriander oil, borneol, fruit extract, and the like. Particularly preferred additional flavorant and aroma agents are essential oils and essences of coffee, tea, cacao, and mint.

The following percentages of components in the tobacco bead core are listed by weight percent of the component in the core and optional inner coating layer, measured after drying and/or coating with an option inner coating layer, and prior to encapsulation with a gel coating.

The menthol and optional flavorant can be present in the core tobacco bead in a combined amount of from about 0.001 wt % to about 50 wt %. More preferably, the amount is from about 1 wt % to about 40 wt %. Most preferably, the amount is from about 10 wt % to about 30 wt %.

The core of the tobacco beads can further comprise natural and/or artificial sweeteners and/or souring agents. Preferred sweeteners include water soluble sweeteners such as monosaccharides, disaccharides and polysaccharides (e.g., xylose, ribose, sucrose, maltose, fructose, glucose, maltose, mannose). In addition, or in the alternative to sweeteners, the tobacco beads can comprise souring agents such as acetic acid, adipic acid, citric acid, lactic acid, maleic acid, succinic acid, tartaric acid, and mixtures thereof. A suitable amount of the sweeteners and/or souring agents can be from about 0.001 wt % to about 5 wt %. More preferably, the amount is from about 0.1 wt % to about 2 wt %.

Humectants can be added to the core of the tobacco beads to maintain and protect the moisture levels of the tobacco material in the tobacco beads. The humectants in the core of the tobacco beads include glycerol and propylene glycol. It is noted that the humectants can also be provided for a preservative effect, as the water activity of the product can be decreased, thus reducing growth of micro-organisms. Additionally, humectants can be used to provide a higher moisture feel in a drier tobacco material (or tobacco substitute material) or a drier smokeless tobacco material. The humectant can be present in the core in an amount of from about 0.001 wt % to about 5 wt %. More preferably, the amount is from about 0.1 wt % to about 2 wt %.

The core of the tobacco beads can further include binders such as mono or polysaccharide based materials, modified cellulosics, etc. A suitable amount of the binders in the core can be up to about 20 wt % and more preferably the amount can be up to about 10 wt %.

Starches and/or cellulose ethers can be added to the core as a thickening agent or binding agent. Polymers such as polyvinyl pyrrolidone (which preferably also serves as a sequestering agent) and polyvinyl alcohol, and gums such as xanthan gum, gum Arabic, and acacia gum can be used as thickening agents. Generally, the stiffness of tobacco beads can be increased and the dissolution rate (i.e., dissolution upon exposure to moisture) can be decreased by increasing the average molecular weight of polymers used. Thickening agents can be added to the core of the tobacco beads to increase the modulus (i.e., stiffness) of the tobacco beads and decrease the propensity toward deforming of the tobacco beads during or after drying (e.g., during storage). Thickening agents can comprise up to about 20 wt. % and more preferably up to about 5 wt. %.

Surfactants can also be added to the core of the tobacco beads. The surfactants include, but are not limited to, the mono and diglycerides of fatty acids, lactylates, pluronic acid, polyoxyethylene sorbitol esters, latanol, and sodium lauryl sulfate. Surfactants can be present in the core in an amount of up to about 10 wt. % and more preferably in an amount of up to about 2 wt. %.

The core of the tobacco beads can further comprise stabilizing agents. Exemplary stabilizing agents are gums such as guar gum, xanthan gum, locust bean gum, and carrageenan. Stabilizing agents can be present in the core in an amount of up to 10 wt. % and more preferably in an amount of up to about 2 wt. % of the final composition of the tobacco beads.

Tobacco beads can also comprise antioxidants and/or preservatives. Exemplary antioxidants include ascorbic acid, vitamin E and sodium pyrosulfate. Exemplary preservatives include acetic acid, benzoic acid, citric acid, lactic acid, malic acid, sorbic acid, and tartaric acid. A suitable amount of the antioxidants and/or preservatives in the core can be up to about 5 wt % and more preferably up to about 2 wt %.

Plasticizing agents can also be added to the core of the tobacco beads. The plasticizing agents can be used to control the stiffness of the tobacco beads, as well as the viscosity of the wet mass from which tobacco beads are prepared. Exemplary plasticizing agents include monoacetin, diacetin, triacetin, glycols such as polyethylene glycol and propylene glycol, polyhydric alcohols such as glycerin and sorbitol, mineral oils, vegetable oils, glycerol and glycerol esters such as glycerol triacetate. Plasticizing agents be present in the core in an amount of up to about 20 wt. % and more preferably in an amount of up to about 5 wt. %.

The core of the tobacco beads optionally includes one or more sequestering agents, including complexing agents. These are agents that can bind targeted constituents in the core (for example, tobacco-specific nitrosamines) and reduce their diffusion or transport to the mouth. Suitable sequestering agents include, but are not limited to, polyvinylpolypyrolidone. A suitable amount of the sequestering agents in the core can be up to about 5 wt % and more preferably up to about 2 wt %.

The core of the tobacco beads can further comprise filling agents to control the tobacco beads' physical properties (e.g., texture, weight, etc.). Exemplary filling agents include cellulose, titanium oxide, magnesium silicate (e.g., talc), aluminum silicate, magnesium carbonate, calcium carbonate (e.g., limestone), calcium phosphate, calcium sulfate, zinc oxide, aluminum oxide, and mixtures thereof. Filling agents can be used to modify the texture of the tobacco beads. Filling agents such as carbonate and phosphate salts can also be used to adjust the pH of the tobacco beads. According to a preferred embodiment, the pH of the tobacco beads is greater than 5, more preferably greater than 6 (e.g., greater than 6.5, 7, or 7.5). The filling agents can be incorporated in the core in an amount of up to about 50 wt. %.

Coating Layer

The tobacco bead core is substantially surrounded by at least one coating layer. The coating is preferably applied to the tobacco bead by contacting the bead with a cation and then introducing the bead into a solution of coating material so that ionic gelation occurs, thereby creating a gel coating around the tobacco bead. The result is an encapsulated tobacco bead having a core-shell structure. The gel coating preferably swells when in contact with water, and provides a desirable sustained release of the contents of the core.

Prior to application of the gel coating, the core may first receive an optional inner coating layer.

The coating layer can include flavorants, natural and/or artificial sweeteners, souring agents, humectants, binders, thickening agents, pigments, surfactants, stabilizing agents, oxygen scavengers and/or antioxidants, and/or preservatives, etc. These additives have been described above with respect to the core of the tobacco beads.

The coating layer is a crosslinked polymer which obtained by ionic gelation. According to an embodiment, suitable ions can be selected from the group consisting of sodium, potassium, calcium, aluminum, lanthanum, magnesium, and barium.

According to an embodiment, such a polymer can be selected from among alginates, pectinates, and carrageenan. The polymer can be present in the coating layer in an amount of up to about 95 wt %, more preferably from about 0.5 wt % to about 85 wt %, and most preferably from about 10 wt % to about 75 wt % based on the total weight of the coating layer.

Multiple coating layers can be coated on the surface of the core such that each coating layer is discrete and/or fused. An optional flavorant can be the same or different in the multiple coating layers coated on the surface of the core.

Further, a coating layer (for example the outer or outermost coating layer) can be engineered to have specific porosity which is one of the primary ways to control a rate of diffusion of the components in the core through the porous outer coating layer. If alginates are used to form the outer coating layer then the porosity of the outer coating layer can be controlled by adjusting the ratio of guluronic to mannuronic units in the alginate.

The crosslinking density of alginates can be controlled by the ratio of M:G (mannuronic acid to guluronic acid) units in the alginate. The solution used can preferably be based on sodium alginate. Alginates having a high content of mannuronic acid residues (mannuronic:guluronic ratio greater than 1:1 and preferably about 1.5:1 to about 3:1) are preferred when the core of the encapsulated tobacco bead has a fluid consistency. In contrast, alginates having a high content of guluronic acid residues (mannuronic:guluronic ratio less than 1:1 and preferably about 0.4:1 to about 0.6:1) are preferred when the core of the encapsulated tobacco bead has a gelled consistency.

Process of Making Tobacco Encapsulated Tobacco Beads

According to an embodiment, a process of making encapsulated tobacco beads comprises mixing tobacco particles and menthol in an aqueous solution to form a wet mass; extruding the wet mass to form extrudates; spheronizing the extrudates to form tobacco beads; contacting the beads with a solution comprising a cation; and introducing the contacted tobacco beads into a solution of coating material where the concentration of coating material is effective to induce ionic gelation of the coating material around the beads, to form encapsulated tobacco beads having gel coatings.

The solution comprising a cation preferably comprises water, optionally includes an alcohol (preferably ethanol) and one or more cations. Preferred cations are selected from the group consisting of sodium, potassium, calcium, aluminum, lanthanum, magnesium, and barium.

The coating material is preferably a polymeric material selected from among alginates, pectins, and carrageenan (for example, kappa-carrageenan).

The tobacco beads and/or the coating layer can comprise (i) natural and/or artificial sweeteners, (ii) at least one humectant, (iii) at least one binder, (iv) at least one thickening agent, (v) at least one pigment, (vi) at least one surfactant, (vii) at least one stabilizing agent, (viii) at least one antioxidant, (ix) at least one preservative, and/or (x) at least one flavorant in addition to the menthol.

The tobacco beads can comprise (i) at least one plasticizing agent, (ii) complexing and/or sequestering agent, (iii) at least one filling agent, and/or (iv) at least one protein.

A flavorant in the coating can be the same or different as a flavorant in the core.

The contacting with the solution comprising the cation can be achieved by spraying, dipping, immersion, drum coating, or fluidized bed coating.

The wet mass can be prepared in any suitable mixer. Preferably, the mixer is a planetary mixer. Further, the wet mass can be extruded through suitably sized pierced screens and spheronized using a rotating disk having a grooved surface.

The extrusion can be carried out using extruders such as the screw, sieve and basket, roll, and ram type extruders. Furthermore, spheronization can be carried out using a spinning friction plate that effects rounding of extrudate particles. Details of extrusion and spheronization techniques can be found in U.S. Pat. No. 5,725,886, the entirety of which is incorporated herein by reference.

Water is preferably used to provide the wet mass with desired rheological characteristics. For example, the water content can be adjusted to achieve the desired plasticity, e.g., the water content may range from 20% to 80% (preferably 40 to 60%) by weight, or about proportions of one-to-four to four-to-one of liquid to dry material. The liquid content of the wet mass is preferably adjusted to account for the effect on the rheological characteristics of the wet mass of any other components added thereto for inclusion in the tobacco bead.

The tobacco beads can be produced in the form of "spheroids" or "ovals" having their largest diameters in the range of about 0.1 to about 2.5 or 3 mm, more preferably from about 0.2 to about 1.2 mm and most preferably from about 0.4 to about 1.0 mm (and any 0.1 mm value in between these ranges).

Following spheronization, wet tobacco beads are dried, preferably in a fluidized bed or conventional convection oven or vacuum oven. The beads are preferably dried to a moisture level of about 0.5% to about 25%, for example 10% or 20%.

The drying can be done more than once, at different stages in the process, for example during or after contacting with the cation and before introducing the coating material, after forming the gel coating, and/or before contacting with the cation.

After spheronization, the beads are contacted with the solution comprising the cation. In an embodiment, the cation is applied via spraying in a fluidized bed drier immediately after spheronization, preferably at the same time the beads are dried. Preferably, at the time of contacting the beads with the solution comprising the cation, the beads contain at least 5%, 10%, 20%, 30%, or 40% moisture by weight.

The gel coating layer preferably substantially surrounds the core and can be formed of various coating materials. If the outer coating layer is of the alginate or pectinate type, the tobacco beads are preferably first contacted with a solution of calcium chloride or other suitable divalent cation. Calcium chloride is a crosslinking agent for alginates and pectinates. If kappa-carageenan is used for the outer coating layer, then monovalent cations such as potassium are preferably used to induce crosslinking.

According to one embodiment, the outer coating layer can be formed on the tobacco beads that are obtained by the process described above by introducing the tobacco beads into a solution of alginate. The presence of $Ca^{2+}$ ions leads to the formation of a spherical coating layer around the tobacco based core. The alginate solution can also include additives such as flavorants, pigments, binders, pH stabilizers, etc., so that during the formation of the coating layer these additives are entrapped in the alginate matrix. The additives have been described above with respect to the core.

According to another embodiment, coating of the core with the coating material may be achieved via fluidized bed coating or a pan coating process.

In one embodiment, after the coating layer is formed on the core, the bead product having a core-shell structure can be subjected to pasteurization. Additional flavorants can be added to the encapsulated tobacco bead having a core-shell structure after the core-shell structure has been formed.

In another embodiment, the bead having a core-shell structure can be dried to allow for improved flowability and ease of packing.

The coating layer can be translucent or substantially opaque.

Flavorants can be admixed with the gelatin or sugar based formulation, respectively. The flavorant containing binders can also be combined with the solid ingredients to form encapsulated products of the matrix type.

Inner Coating Layer

The encapsulated tobacco bead may optionally include an inner coating layer substantially surrounding the core and under the gel coating.

Coating materials as described above may be used for the inner coating layer. Other coating materials suitable for an inner coating layer are gum arabic, KOLLICOAT IR (a polyvinyl alcohol-polyethylene glycol graft copolymer), and hydroxypropyl methylcellulose (HPMC). If the inner coating layer is HPMC, it is preferred that the cation solution comprises an alcohol.

Coating of the core with the inner coating layer may be achieved via fluidized bed coating or a pan coating process. If fluidized bed coating is used, then preferably the coating with the inner coating layer occurs simultaneously with the drying the tobacco beads Various Uses of the Tobacco Beads These tobacco beads can be used in snus type products and/or in smoking articles such as cigarettes. In one embodiment, when multiple coating layers are coated on the core and the core and coating layers have different flavorants, a multiple flavor experience is provided to a user over a period of time as each coating layer is dissolved or combusted.

The "snus" type product can be placed directly in a user's mouth and can provide: (1) controlled flavorant(s) delivery from the coating layer and the inside core to the mouth, (2) potentially reduced exposure to tobacco specific compounds, (3) enhanced sensorial attributes, and (4) reduced staining of the pouch material surrounding the tobacco material. Moreover, the smokeless tobacco product or "snus" as described herein has an extended shelf life and product stability.

U.S. Publication Nos. 2007/0261707 and 2007/0012328, each of which is incorporated herein by reference in their entirety, provide examples of smokeless tobacco products into which the herein-described beads may be incorporated.

The tobacco beads can also be used in cigarettes as flavorant carriers that can be added to a cigarette filter for controlled flavorant delivery in the filter as described in commonly-assigned U.S. Patent Application Publication No. 2007/0000505, incorporated herein by reference.

The tobacco beads can also aid in selective filtration when used in a cigarette due to the incorporation of selective binding agents in the outer coating layer or the core of the tobacco beads.

In an embodiment, a mentholated smoking article (such as a cigarette) contains no menthol in the tobacco rod, but instead the menthol is provided by means of one or more tobacco beads in a filter. Such an arrangement simplifies tobacco processing and eliminates issues such as staining that are typically associated with direct applications of menthol to the tobacco filler of the tobacco rod.

Further, when the tobacco beads are used as tobacco filler of a smoking article a reduction in the formation of undesired tobacco specific compounds in mainstream smoke can be achieved. Without wishing to be bound by theory, a reduction in the formation of tobacco specific compounds could be achieved in this way: as the outer coating layer is pyrolyzed, it forms a layer of charred material through which labile flavorants are easily transported, but heavier compounds resulting from tobacco pyrolysis, and which tend to partition in the particulate phase, are substantially restricted from being released.

EXAMPLES

The materials used in the following Examples are summarized as follows. Ground tobacco (HV-305, HV-304, or LV 380) and synthetic menthol were used as received. HPMC and gum arabic (from acacia tree) were obtained from Sigma-Aldrich (St. Louis, Mo.). Calcium chloride was obtained from Fisher Scientific (Fair Lawn, Fla.). Kollicoat® IR (for "Instant Release"), a polyvinyl alcohol-polyethylene glycol graft copolymer, is available from BASF (Belvidere, N.J.). The commercially available encapsulated menthol-gum powder CR200, containing 80 wt % of menthol and 20 wt % of gum arabic, was supplied by TasteTech (United Kingdom). Food colorings were obtained from the C. F. Sauer Company (Richmond, Va.).

Example 1

The following sub-examples recite methods used to create tobacco beads. The resulting tobacco beads formed are ready for further processing including contacting with a cation and coating material for forming a gel coating, e.g. as detailed in Example 3 below.

Sub-example A: 200 parts of ground tobacco, 75 parts of menthol-(gum arabic) powder CR200 (Tastetech, UK) and 108 parts of deionized water were mixed to form a wet mass. The wet mass was extruded using a single-screw extruder (LCI Multi-Granulator MG-55) through a dome shaped, 0.7-mm opening die at an extrusion speed of 60 rpm. The resulting extrudates were spheronized using an LCI QJ-230T Marumerizer at a rotation speed of 1400 rpm for 6 minutes. Wet spheroids with narrow size distribution were obtained. The resulting beads contained 16 wt % menthol.

Sub-example B: 126 parts of ground tobacco were first mixed with 178 parts of deionized water. The mixture was heated up in an oven and kept at 50° C. Synthetic menthol was melted at 50° C. 162 parts of molten menthol was mixed with the (tobacco dust)/(deionized water) mixture to form a wet mass. The wet mass was extruded using a single-screw extruder (LCI Multi-Granulator MG-55) through a dome shaped, 0.7-mm opening die at an extrusion speed of 60 rpm. The resulting extrudates were spheronized using an LCI QJ-230T Marumerizer at a rotation speed of 1400 rpm for 6 minutes. Wet spheroids with narrow size distribution were obtained. The wet spheroids were subsequently dried in a fluidized bed (Mini Glatt, German) at room temperature for 1 hour to remove water. The resulting beads contained 50 wt % menthol.

Sub-example C: 126 parts of ground tobacco were first mixed with 178 parts of deionized water. The mixture was heated up in an oven and kept at 50° C. Synthetic menthol was melted at 50° C. 162 parts of molten menthol was mixed with the (tobacco dust)/(deionized water) mixture to form a wet mass. The wet mass was extruded using a single-screw extruder (LCI Multi-Granulator MG-55) through a dome shaped, 0.7-mm opening die at an extrusion speed of 60 rpm. The resulting extrudates were spheronized using an LCI QJ-230T Marumerizer at a rotation speed of 1400 rpm for 6 minutes. Wet spheroids with narrow size distribution were obtained. The wet spheroids were subsequently coated with 5 wt % hydroxypropyl methylcellulose aqueous solution in a fluidized bed coater (Mini Glatt, German) at 30° C. for 2 hours. The resulting beads contained 48 wt % menthol.

Sub-example D: 50 parts of ground tobacco were first mixed with 18 parts of deionized water. The mixture was heated up in an oven and kept at 50° C. A mixture of 50 parts of synthetic menthol and 10 parts of cocoa butter was melted at 50° C. The (molten menthol)/(cocoa butter) mixture was mixed with the (ground tobacco)/(deionized water) mixture to form a wet mass. The wet mass was extruded using a single-screw extruder (LCI Multi-Granulator MG-55) through a dome shaped, 0.7-mm opening die at an extrusion speed of 60 rpm. The resulting extrudates were spheronized using an LCI QJ-230T Marumerizer at a rotation speed of 1400 rpm for 6 minutes. Wet spheroids with narrow size distribution were obtained. The resulting beads contained 36 wt % menthol.

Sub-example E: 50 parts of ground tobacco were first mixed with 30 parts of deionized water. The mixture was heated up in an oven and kept at 50° C. 20 parts of synthetic menthol was melted at 50° C. The molten menthol was mixed with the (ground tobacco)/(deionized water) mixture to form a wet mass. The wet mass was extruded using a single-screw extruder (LCI Multi-Granulator MG-55) through a dome shaped, 0.7-mm opening die at an extrusion speed of 60 rpm. The resulting extrudates were spheronized using an LCI QJ-230T Marumerizer at a rotation speed of 1400 rpm for 6 minutes. Wet spheroids with narrow size distribution were obtained. The wet spheroids were subsequently dried in a convection oven under a vacuum pressure of −5 in Hg at 35° C. for 2 hours to remove water. The resulting beads contained 24 wt % menthol.

Example 2

Mentholated tobacco beads were coated with an inner coating layer as follows using a fluidized bed coater.

HPMC aqueous solutions at different HPMC amounts (1, 2, 3 or 5 wt %), 5 wt % Kollicoat® IR aqueous solution, and 5 wt % gum arabic aqueous solution are used to coat mentholated tobacco beads prepared according to Example 1 in a fluidized bed coater assembled with a Wurster insert (Mini Glatt, Glatt Corporation, Germany). For each batch, the coating temperature was 30° C. and the coating time varied from 2 to 4 hours. The flow rate of the polymer solution is 0.42 g/min. This coating procedure was effective to dry the beads so that no separate drying step was required.

The resulting beads with a coating layer of HPMC are ready for further processing by contacting with a cation and coating material for form a gel coating, as detailed in Example 4 below.

Example 3

Mentholated tobacco beads were coated with crosslinked alginate as follows.

Dried tobacco beads prepared according to Example 1 are contacted with a 5 wt % calcium chloride ($CaCl_2$) aqueous solution by immersion for 30 seconds and then contacted with a 0.25 wt % sodium alginate solution by immersion for 15 mins. A thin layer of calcium alginate is formed on the surface of tobacco beads. The coated beads are washed with distilled water and dried in ambient conditions.

Example 4

A method similar to that of Example 3 is used to form a crosslinked alginate coating on the HPMC coated tobacco beads obtained from Example 2, however, in this instance, a 15 wt % $CaCl_2$ ethanol solution was used in place of the 5% $CaCl_2$ aqueous solution.

Example 5

Mentholated tobacco beads prepared according to Example 1 were coated with a 2 wt % pectin solution in the fluidized bed coater during a drying step. The coating time was 4 hours. The resulting beads are ready for further processing by contacting with a cation and coating material for form a gel coating.

Example 6

Mentholated tobacco beads were created using either molten synthetic menthol or CR200 menthol-gum powder as described in Example 1. The beads were vacuum-dried at 30° C. for six hours, then sealed in vials and stored at room conditions overnight. The resulting beads are ready for further processing by contacting with a cation and coating material for form a gel coating.

Analysis & Results

Figure 1B:
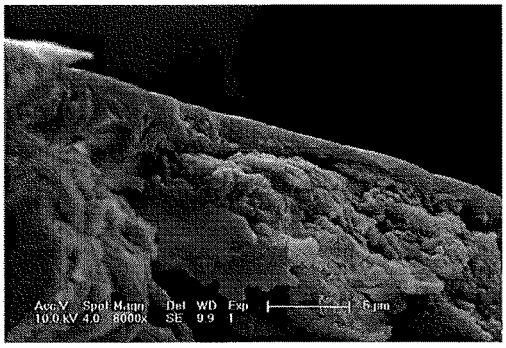

The coating layer thickness and morphologies were characterized via environmental scanning electron microscopy ("ESEM"). ESEM images of pectin coated mentholated tobacco beads are shown in FIGS. 1A-B. FIG. 1A shows an unbroken bead, while FIG. 1B shows a cross-section of a broken bead. The pectin coating was 1.9 μm thick (FIG. 1B), and the coating thickness was fairly uniform.

Figure 2:
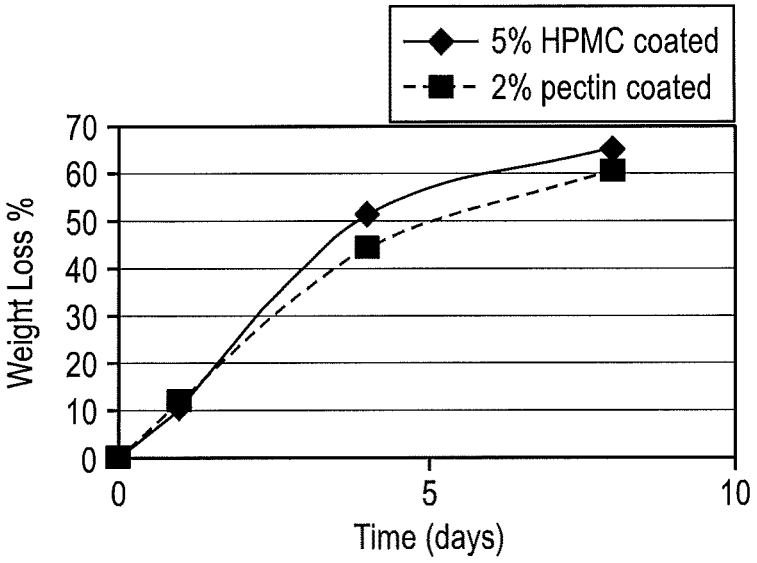
FIG. 2 is a graph showing weight losses of hydroxypropyl methylcellulose ("HPMC") coated and pectin coated mentholated tobacco beads as a function of time in vacuum oven.

Menthol release was analyzed by examining the weight losses of 5 wt % HPMC coated from Example 2 and 2 wt % pectin coated mentholated tobacco beads from Example 5 in a vacuum oven at 30° C. Because the mentholated tobacco beads lost most of their water during fluidized bed coating, the weight losses here were mostly attributable to loss of menthol. The results are shown in FIG. 2. The menthol release rate of HPMC coated mentholated tobacco beads is slightly higher than the release rate of pectin coated beads after the first day. This indicated that a pectin coating may provide better protection for menthol in mentholated tobacco beads, even though the pectin coating is thinner. Without wishing to be bound by theory, it is believed that this might be because pectin could react with the calcium ions in the tobacco particles, which may help form denser matrices in the beads.

Figure 3A:
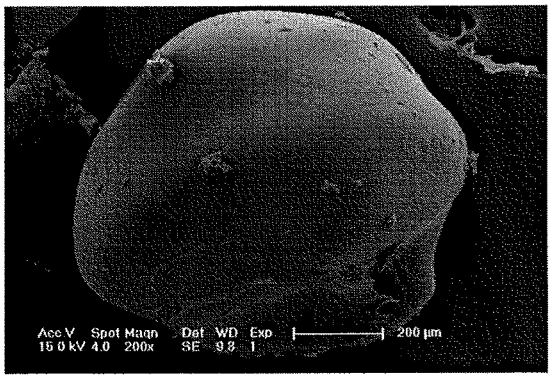
FIGS. 3A and 3B are ESEM images of crosslinked alginate coated tobacco beads (dry coating).
Figure 3B:
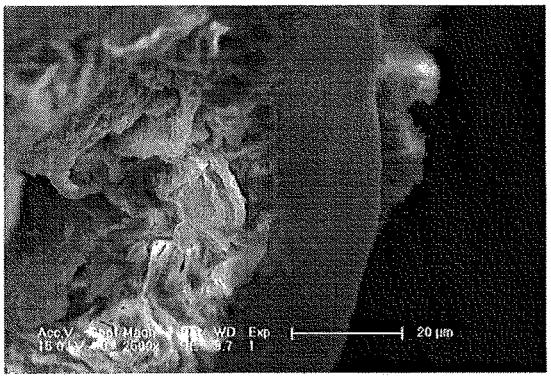

A tobacco bead formed as described in Example 3 was dried. An optical microscope image of the crosslinked alginate on a tobacco bead after drying are shown in FIGS. 3A and B (showing an unbroken and broken bead, respectively). The images show that crosslinked alginate can be successfully coated on the beads via this technique. The coating surface is smooth and varied in thickness from 16 to 40 μm.

Figure 4:
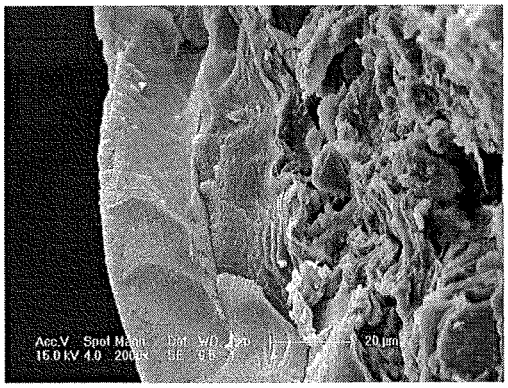
FIG. 4 is an ESEM image of a HPMC/crosslinked alginate coated mentholated tobacco bead.

A HPMC/crosslinked alginate dual-layer coating was obtained as described in Example 4. ESEM images of HPMC/crosslinked alginate coated tobacco beads are shown in FIG. 4. A dual-layer coating was identifiable in most areas on the bead. The total thickness of the coating layer was about 30 to 40 μm.

Regarding the Example 6 wherein mentholated tobacco beads were created using either molten synthetic menthol or CR200 menthol-gum powder, it was found that menthol crystallized on the walls of the vials containing bead made with liquid synthetic menthol, but not on the walls of the vials containing beads made with the encapsulated menthol gum powder CR200. This demonstrated that the menthol gum powder slowed release of menthol from mentholated tobacco beads.

Although the invention has been described with reference to particular embodiments and examples, it should be understood that various modifications can be made without departing from the spirit of the invention. The various parts of the disclosure including the abstract, summary, and the title are not to be construed as limiting the scope of the present invention, as their purpose is to enable the appropriate authorities, as well as the general public, to quickly determine the general nature of the invention. Unless the term "means" is expressly used, none of the features or elements recited herein should be construed as means-plus-function limitations. Accordingly, the invention is limited only by the claims.

What is claimed is:

1. A process of making encapsulated tobacco beads comprising:

mixing tobacco particles and menthol in an aqueous solution to form a wet mass;

extruding the wet mass to form extrudates;

spheronizing the extrudates to form wet spheroids;

drying the wet spheroids in a fluidized bed coater to provide coated tobacco beads having an inner coating of hydroxypropyl methylcellulose (HPMC);

contacting the coated tobacco beads with a solution comprising a cation to form contacted tobacco beads, the cation selected from the group consisting of sodium, potassium, calcium, aluminum, lanthanum, magnesium, and barium; and introducing the contacted tobacco beads into a solution of an outer coating material in a concentration effective to induce ionic gelation of the outer coating material around the beads, to form encapsulated tobacco beads having outer gel coatings, wherein the outer gel coatings have a thickness of about 2μm to about 40μm, and wherein the solution of outer coating material further comprises a flavorant, the flavorant being in an encapsulated form and the flavorant being incorporated into the outer gel coatings.

2. The process of claim 1, wherein the menthol comprises molten menthol or menthol-gum Arabic powder containing 20 wt. % gum Arabic and 80 wt. % menthol.

3. The process of claim 1, wherein before introducing the contacted tobacco beads into a solution of outer coating material, the tobacco beads comprise 24% or greater menthol by weight.

4. The process of claim 1, wherein:

(a) the flavorant is solid or liquid;

(b) the flavorant is soluble or insoluble in water or organic solvents selected from the group consisting of ethanol, propylene glycol, and mixtures thereof;

(c) the flavorant is selected from the group consisting of natural and synthetic flavorants; and/or (d) the flavorant is selected from the group consisting of peppermint, spearmint, wintergreen, menthol, cinnamon, chocolate, vanillin, licorice, clove, anise, sandalwood, geranium, rose oil, vanilla, lemon oil, cassia, spearmint, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, peppermint oil, orange oil, coriander oil, borneol, fruit extract, and combinations thereof.

5. The process of claim 1, wherein:

(a) the outer coating material comprises a material selected from the group consisting of alginates, pectins, and carrageenan;

(b) the tobacco beads and/or the gel coating comprise (i) one or more natural and/or artificial sweeteners, (ii) at least one humectant, (iii) at least one binder, (iv) at least one thickening agent, (v) at least one pigment, (vi) at least one surfactant, (vii) at least one stabilizing agent, (viii) at least one antioxidant, or (ix) at least one preservative;

(c) the tobacco beads further comprises (i) at least one plasticizing agent, (ii) at least one filling agent, and/or (iii) at least one protein;

(d) the encapsulated tobacco beads further comprise at least a second outer coating that is at least partially fused to said outer gel coating and/or discrete from said outer gel coating;

(e) at the time of contacting the beads with the solution comprising the cation, the beads contain at least 5%, 10%, 20%, 30%, or 40% moisture by weight; and/or (f) the tobacco beads encapsulated with outer gel coatings are substantially spherical with diameters of from about 0.1 mm to about 2.5 mm.

6. The process of claim 1, wherein the encapsulated tobacco beads further comprise a sequestering agent.

7. The process of claim 6, wherein the sequestering agent comprises polyvinylpolypyrolidone.

8. The process of claim 1 wherein the process includes a pasteurization step.

9. The process of claim 1, further comprising incorporating the encapsulated tobacco beads into a smoking article or into a smokeless tobacco product.

10. The process of claim 1, wherein the process further comprises drying the encapsulated beads having outer gel coatings.

11. the process of claim 1, wherein the outer coating material comprises alginate having a ratio of mannuronic units to guluronic units of about 0.4:1 to about 0.6:1.

* * * * *